US005733072A

United States Patent [19]

Hilfiker et al.

[11] Patent Number: 5,733,072

[45] Date of Patent: Mar. 31, 1998

[54] WIREWALL WITH STIFFENED HIGH WIRE DENSITY FACE

[75] Inventors: William K. Hilfiker, 3718 Grapevine Dr., Grapevine, Tex. 76051; Thomas P. Taylor, Euless, Tex.

[73] Assignee: William K. Hilfiker, Grapevine, Tex.

[21] Appl. No.: 690,005

[22] Filed: Jul. 31, 1996

[51] Int. Cl.[6] ..... E02D 17/20

[52] U.S. Cl. ..... 405/284; 405/262

[58] Field of Search ..... 405/262, 284, 405/286

[56] References Cited

U.S. PATENT DOCUMENTS

| | | | |
|---|---|---|---|
| 4,117,686 | 10/1978 | Hilfiker | 405/284 |
| 4,329,089 | 5/1982 | Hilfiker et al. | 405/262 |
| 4,391,557 | 7/1983 | Hilfiker et al. | 405/287 |
| 4,505,621 | 3/1985 | Hilfiker et al. | 405/284 |
| 4,856,939 | 8/1989 | Hilfiker | 405/284 |
| 5,531,547 | 7/1996 | Shimada | 405/262 |
| 5,622,455 | 4/1997 | Anderson et al. | 405/262 |

*Primary Examiner*—Tamara L. Graysay
*Assistant Examiner*—Tara L. Mayo
*Attorney, Agent, or Firm*—Limbach & Limbach L.L.P.

[57] ABSTRACT

A wire mat for a retaining wall structure has a unique prong portion extending upwardly from a vertical face. The prong portion has a series of bends in its middle that extend over a lower portion of a similar wire mat located immediately above such that the series of bends interleaves with longitudinal members of the wire mat above. In a preferred embodiment one or more connecting pins are inserted between the prong portion and the longitudinal members of the mat above.

11 Claims, 6 Drawing Sheets

WIREWALL WITH STIFFENED HIGH WIRE DENSITY FACE

BACKGROUND OF THE INVENTION

The present invention relates to retaining structures for earthen formations. Such structures are generally known, as typified by U.S. Pat. No. 4,505,621 and U.S. Pat. No. 4,856,939. In these patents, L-shaped wire grids having a floor portion and a face portion are superimposed one on top of the other. The face portions are interconnected to provide a unitary wall face thereby retaining an earthen formation behind the wall. However, such retaining structures utilize a considerable amount of steel wire, some of which will be sacrificed to erosion and oxidation. Therefore, it is desirable to reduce the amount of wire required by such structures, and likewise, to improve the manner of interconnecting the same.

SUMMARY OF THE INVENTION

In its broadest aspects, the present invention is concerned with a soil reinforced earthen retaining wall structure and a welded wire mat for use in such a structure. The wire mat has a horizontal floor portion with a plurality of longitudinal and transverse members and a vertical face portion with a plurality of longitudinal and transverse members. A first mat so constructed also has a prong portion extending upwardly from the face portion. Each prong portion has a series of bends in its middle portion. In a preferred embodiment a transverse wire connects the ends of the prong portions.

A second wire mat similarly configured has its vertical face portion interconnected with the vertical face portion of the first mat. The prong portion of the first wire mat engages a lower portion of the second wire mat such that the series of bends interleaves with the longitudinal members of the second wire mat. In the preferred embodiment a connecting pin is inserted between the bends of the prong portion of the first wire mat and the longitudinal members of the second wire mat.

In its more particular aspects, the invention is concerned with such angle-shaped welded wire mats where the face portions of the mats may be resiliently deflected toward the earthen formation during the course of erection of a retaining wall and engaged to the opposite sides of the prong portion of a next adjacent mat engaged therewith so that, upon release, the face portion of the deflected mat may impart force to the opposite sides of the prong portion of the adjacent mat engaged therewith. Through this interrelationship, the face portions of the mats are secured together and stiffen one another to resist bulging due to backloading from the earthen mass being retained.

A principle object of the present invention is to provide improved mats for use in constructing soil reinforced earthen retaining walls wherein the face portions of adjacent mats reinforce one another and may have a wire density greater than that of the floor portions of the mats.

Another object is to provide such mats wherein the face portions of the mats may be resiliently deflected to enable prong portions on the mats to interengage.

Still another object of the invention is to provide such mats wherein larger diameter wire may be employed in the soil reinforcing floor portions of the mats to reduce the ratio of sacrificial steel in the floor portions.

Still another object is to provide such mats wherein large diameter wires strengthen the face portions of the mats to resist bending as these portions are loaded by the backfill soil of the wall.

Yet another object of the invention is to provide such mats wherein the face portions of successive mats interengage to resist bending as a result of soil loading.

Another object related to the latter object is to provide such mats wherein the face portion of a lower mat exerts force against the face portion of the mat thereabove in the direction of the soil being retained.

Still another object of the invention is to provide a soil reinforced retaining wall comprised of successive courses retained by welded wire mats with interconnected face portions wherein the connection between the mats permits the successive lifts of the wall to settle without placing undue stress at the connection point between the mats.

These and other objects will become more apparent when viewed in light of the following detailed description and accompanying drawings.

DETAILED DESCRIPTION OF THE INVENTION

Figure 1:
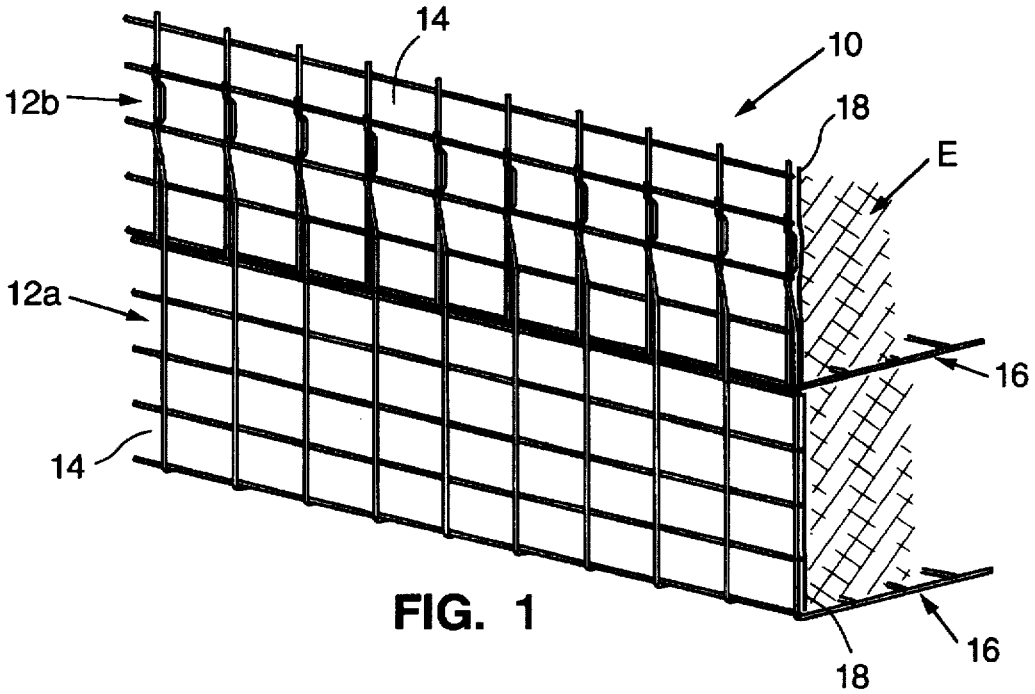
FIG. 1 is a perspective view illustrating an earthen formation retained by a wall constructed according to a first embodiment of the present invention.

Referring now to FIG. 1, an earthen formation "E" is shown retained by a retaining structure 10 constructed according to a first embodiment of the present invention. The retaining structure 10 comprises a plurality of steel wire grids **12*a* and 12*b*, each having a face portion 14 and a floor portion 16. The grids 12*a* and 12*b*** are identical, with the "a" and "b" suffix used only to distinguish the first and second levels, as will be seen in the following description.

In general, when constructing a retaining structure according to the first embodiment of the present invention, a first grid **12*a* is placed in an excavated location with its floor portion 16 on a horizontal earthen surface and its face portion 14 extending upwardly. A layer of filter fabric 18 or other suitable material may be placed against the inside of face portion 14 to improve soil retention capability. The area behind the face portion 14 and above the floor portion 16 is backfilled and compacted. A second grid 12*b* is placed on top of the fill such that its face portion 14 is interconnected with the face portion 14 of the first grid 12*a***. The structure of the grids and the manner of interconnecting successive grids to form the retaining structure will now be described in greater detail.

Figure 2:
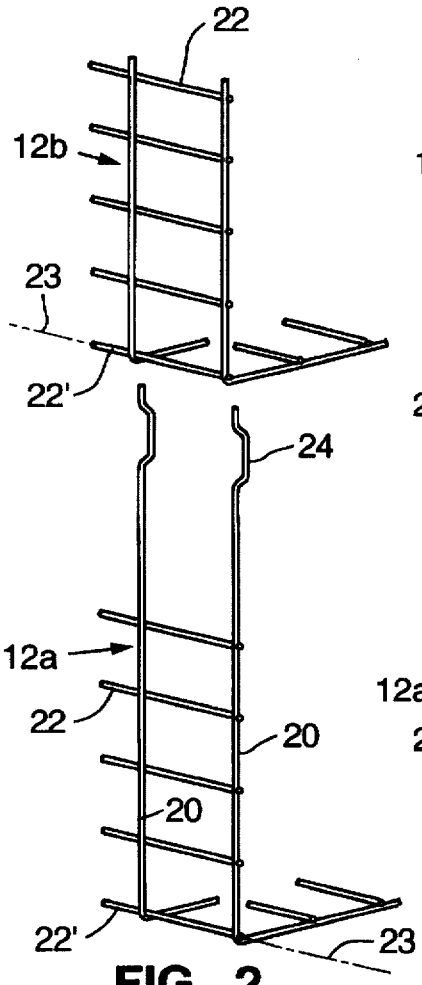
FIGS. 2–4 are perspective views showing the sequence of steps for constructing a wall according to the first embodiment of the present invention.
Figure 3:
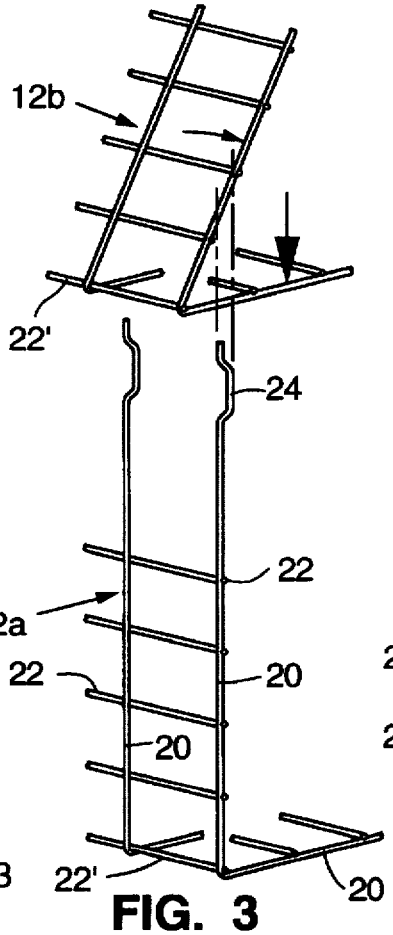
Figure 4:
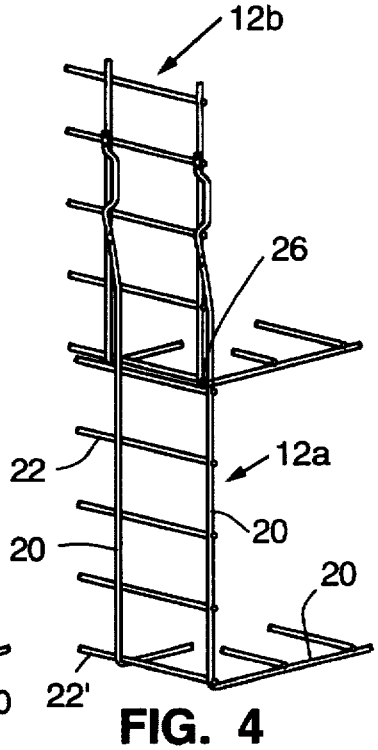

As can be seen with additional clarity in FIGS. 2–4, each wire grid 12*a* and 12*b* is formed with a plurality of longitudinal members 20 and a plurality of transverse members 22, although only a portion of the grid is shown in these Figures. The longitudinal members 20 are generally parallel to each other in a spaced apart relationship. Likewise, the transverse members 22 are generally parallel to each other in a spaced apart relationship, and perpendicular to the longitudinal members 20.

A fold line 23 is formed between the face and floor portions 14 and 16 at one of the transverse members, designated 22'.

The size and spacing of the members 20 and 22 are dependent on the application. A typical embodiment uses W3.5 to W12.0 wire for the grid members 20 and 22 to create three by six inch spacing between the members. However, the interconnecting face portions may have a higher wire density than the floor portions.

As can be seen in FIGS. 2–4, each longitudinal member 20 has a prong portion 24 extending upwardly beyond the last of the transverse members. The prong portion 24 has a deformed section having an inward bend, then a flat portion; then an outward bend, then returning to straight section. The prong portion is used to interconnect grid 12*b* to the grid 12*a* in the following manner. The top grid 12*b* has its face portion 14 resiliently bent at the fold line 23 to form an acute angle with the floor portion 16, as shown in FIG. 3. Then, the top grid 12*b* is moved downward with its fold line wire 22' and the wire 22 immediately thereabove to the front of the prongs 24 and the three wires 22 above the later wire to the back of the prongs 24 (See FIG. 6) until the longitudinal members 20 of its floor portion adjacent to the fold line 23 rest on the top transverse member 22 of the bottom grid 12*a* such that each successive prong portion 24 extends through a successive one of the openings in grid 12*b*. The deformed face portion 14 of the top grid 12*b* is then permitted to resiliently return to the upright position to secure the grids 12*a* and 12*b* together, as shown in FIGS. 4.

Figure 5:
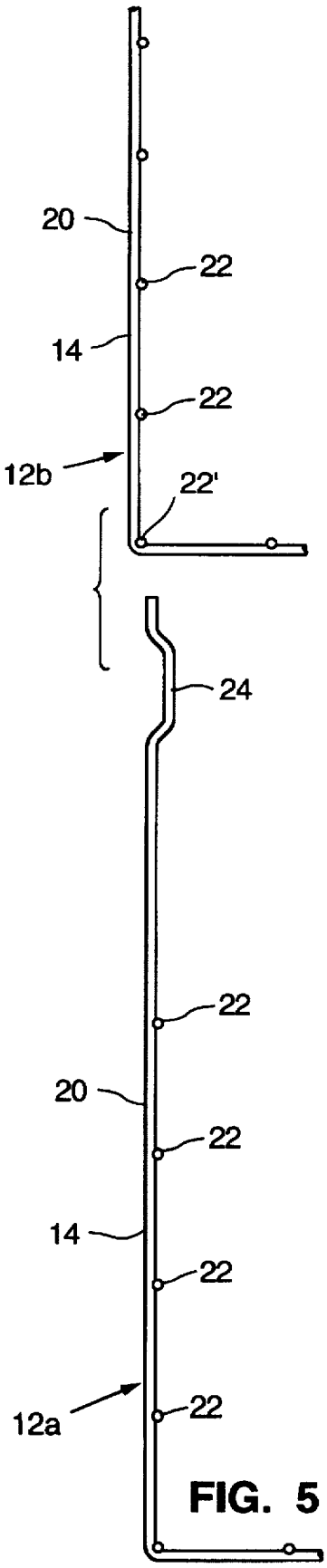
FIGS. 5–7 are side elevational views showing the same sequence of steps illustrated in FIGS. 2–4.
Figure 6:
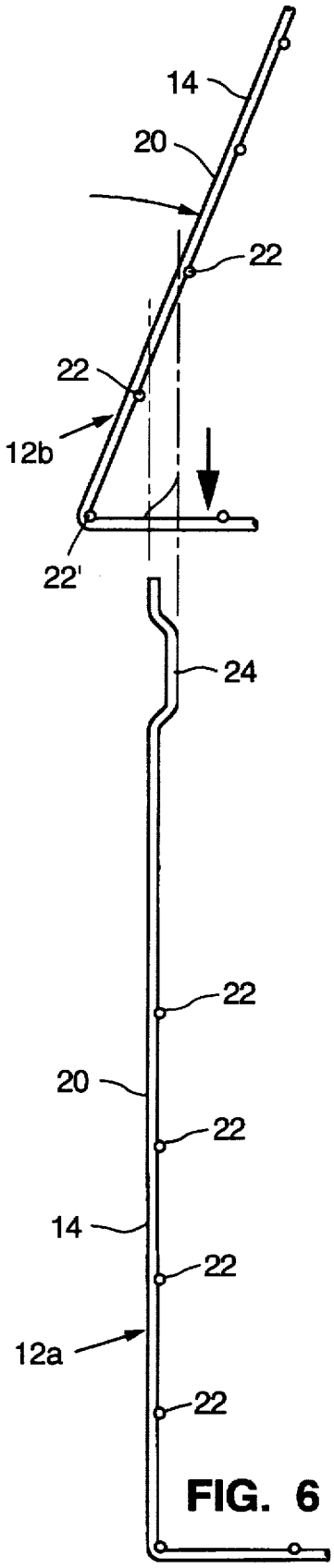
Figure 7:
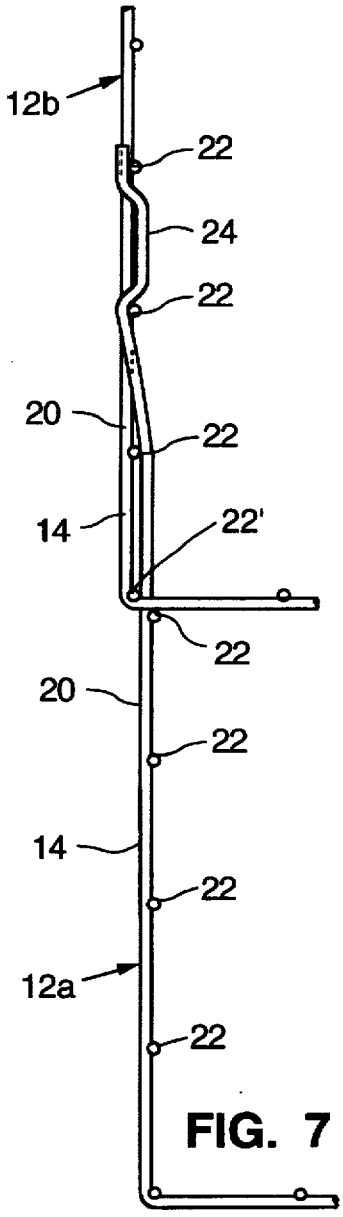
Figure 8:
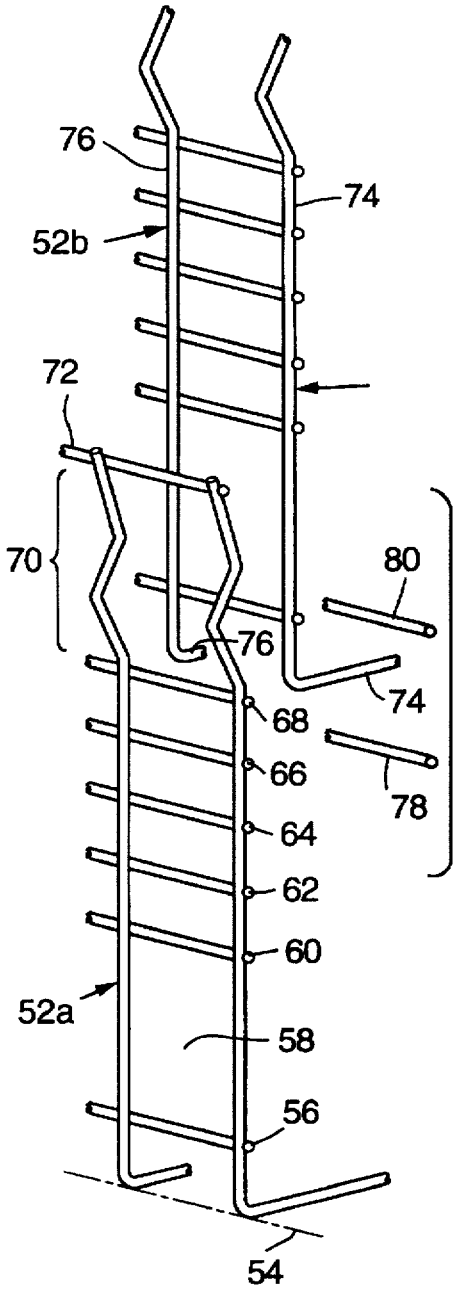
FIGS. 8–10 are perspective views showing the sequence of steps for constructing an earthen wall according to an alternative embodiment of the present invention.

This interconnection is also illustrated in FIGS. 5–7. As there shown, the transverse members 22 are spaced three inches apart and the prong portion 24 extends upwardly from the topmost transverse member 22 by approximately ten inches. Thus, the prong portion 24 extends through the second opening above the fold line 23, and the deformed section is biased into the third opening above the fold line.

Referring now to FIGS. 8–13, the preferred embodiment of the invention is illustrated. In this embodiment, the top grid 52*b* is identical to the bottom grid 52*a* thus permitting successive interconnections for any height required for a retaining structure. The floor portion is substantially omitted in these views, but it should be recognized that the floor portion has longitudinal members and transverse members defining a grid pattern as previously described, although the spacing need not be the same as on the face portion.

The fold line, designated 54, is no longer located at one of the transverse members, but instead, the fold line is three inches below the first of the transverse members 56 on the face portion. A nine inch opening 58 is then provided before the next transverse member 60, then additional transverse members 62, 64, 66 and 68 are provided with spacing of three inches from the previous member.

A prong portion 70 is located above transverse member 68 and bends forward, then backward, then forward again and terminates in a transverse member 72. The total length of the prong portion 70 is approximately nine inches. Each bend is approximately three inches long and angled from the vertical line of the longitudinal member approximately one inch.

Figure 9:
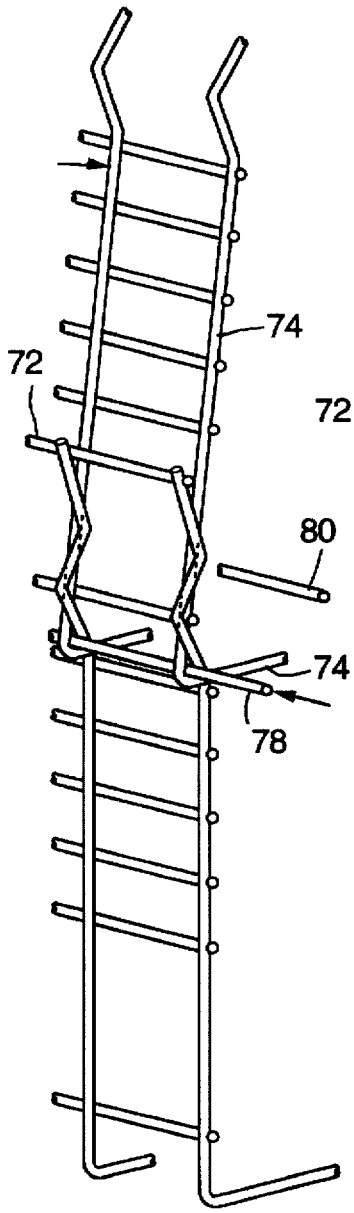
Figure 10:
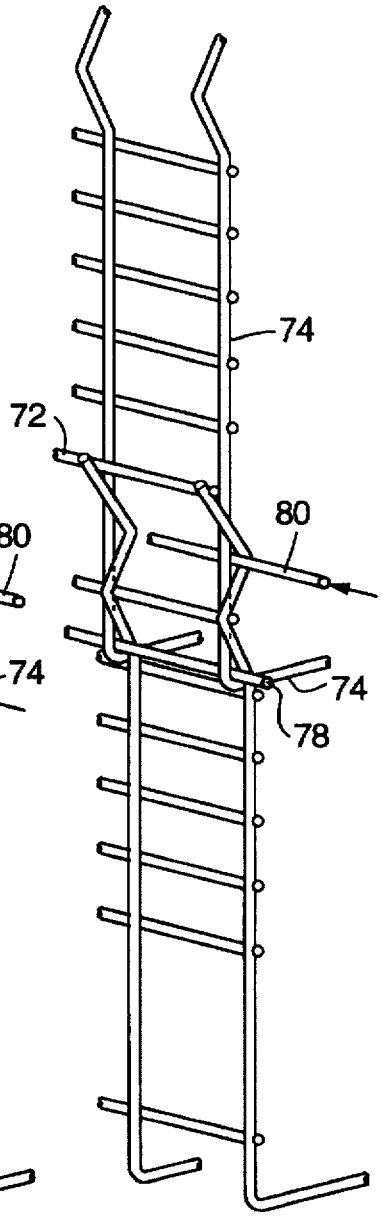
Figure 11:
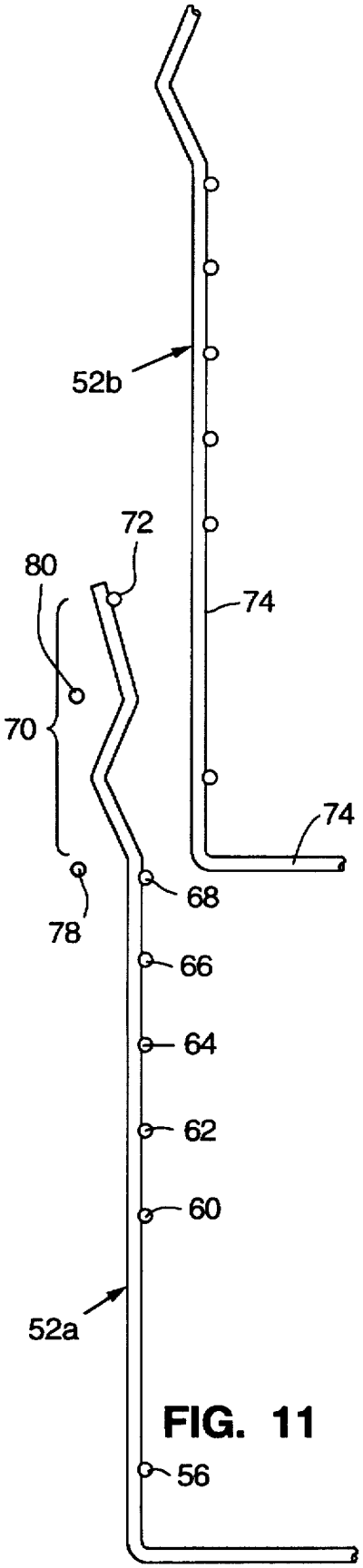
FIGS. 11–13 are side elevational views showing the same sequence of steps illustrated in FIGS. 8–10.
Figure 12:
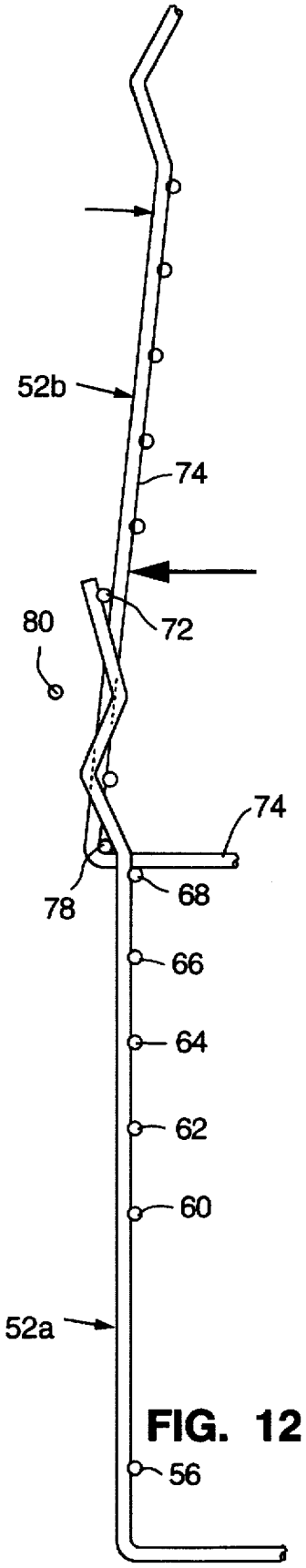
Figure 13:
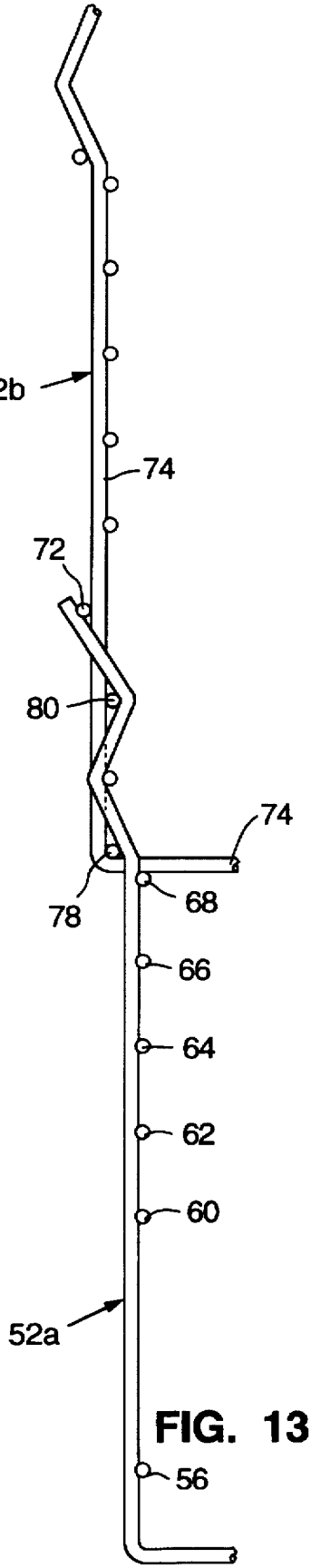

In the FIGS. 8–13 embodiment, the top grid 52*b* is placed on the bottom grid 52*a* to the back of the prong portion 70 such that the longitudinal members 74 and 76 contact and rest upon transverse member 68. The top grid 52*b* is then moved forwardly as its face portion is resiliently forced backward as seen in FIGS. 9 and 12. The force applied to the prong portion of bottom grid 52*a* as the top grid 52*b* is moved forwardly causes its longitudinal members 74 and 76 to extend in front of the prong portion of the bottom grid 52*a* as a result of the prong portion 70 having a forward bend (See FIG. 12). A connecting pin 78 is then inserted into the gap between the longitudinal members of the top grid 52*b* and the bottom grid 52*a*. The top grid 52*b* is then forced forwardly and the face portion returns to an upright position (See FIG. 13). A second connecting pin 80 is then inserted into the gap between the longitudinal members of the top grid 52*b* and the bottom grid 52*a*.

Figure 16:
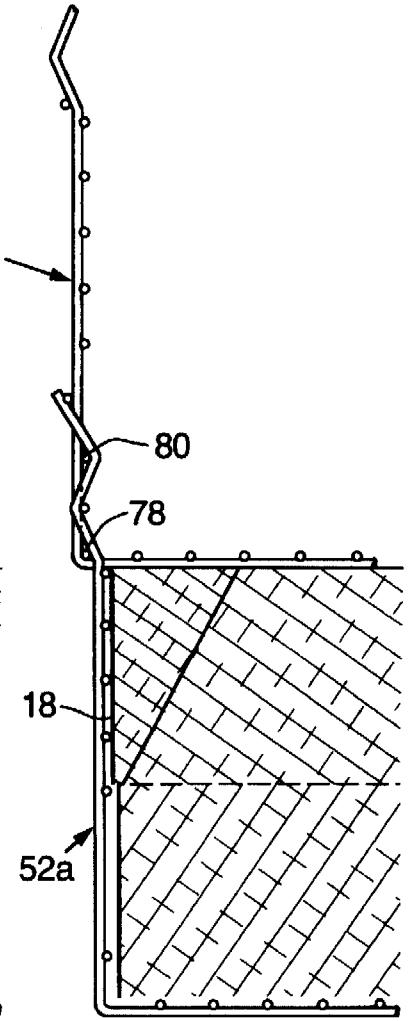
FIGS. 14–16 are side elevational views showing the process for constructing a wall according to the present invention.
Figure 15:
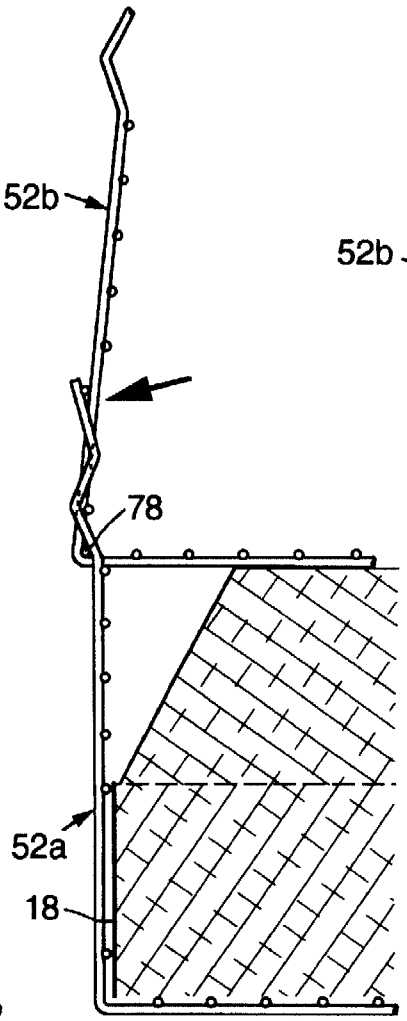
Figure 14:
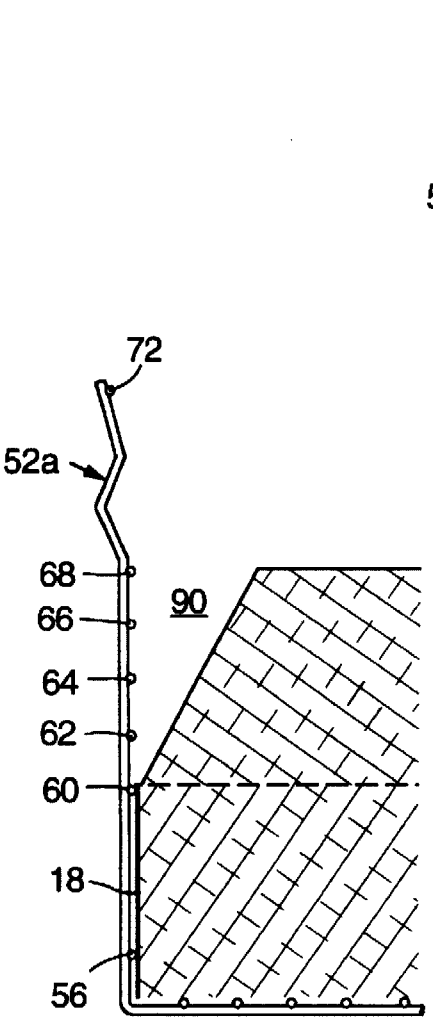

The process for constructing a retaining wall using the preferred grid is illustrated in FIGS. 14–16. First, a standard grid 52*a* is placed in an excavated location and fabric 18 is placed behind the face portion. Twelve inches of fill is placed on the grid and compacted as required. Then an additional twelve inches of fill is placed on the grid and compacted except for a void area 90.

The second grid 52*b* is then placed onto the transverse member 68 of the first grid 52*a*. The face portion of top grid 52*b* is forced backward and the first connection pin 78 is inserted. The face portion of top grid 52*b* is then forced forward and the second connection pin 80 is inserted. The void 90 is then filled and compacted.

Figure 17:
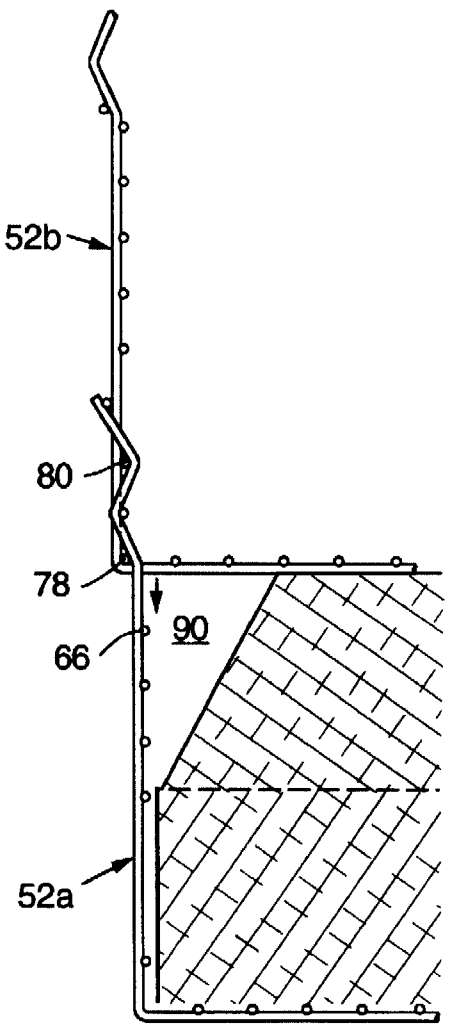
FIG. 17 is a side elevational view showing the process for constructing a wall according to a modified version of the alternative embodiment of the present invention.

A modified version of the preferred embodiment is shown in FIG. 17. This embodiment is generally the same as that shown in FIGS. 14–16, except that the transverse member 68 is omitted from the grid. Otherwise, the grid is the same and the process for constructing a retaining structure using the grid is the same. Omission of transverse member 68 aids in preventing buckling of the structure if significant settling of the compacted fill occurs.

Figure 18:
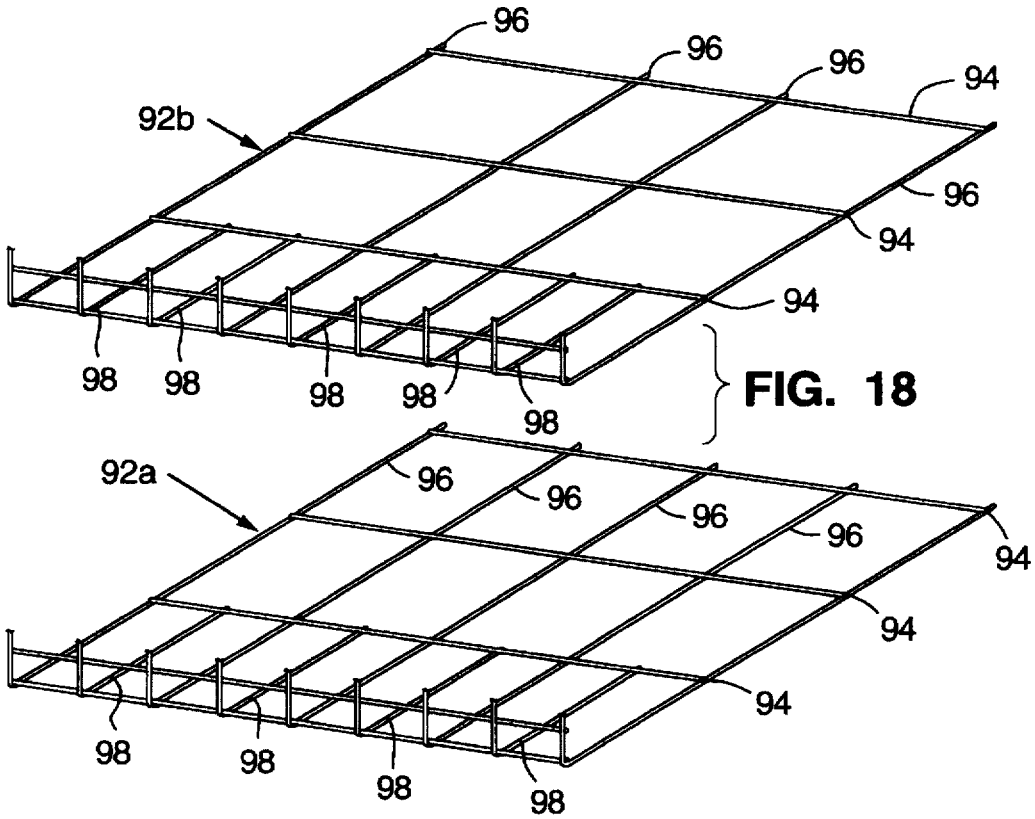
FIGS. 18 and 19 illustrate alternative floor grid member spacing.
Figure 19:
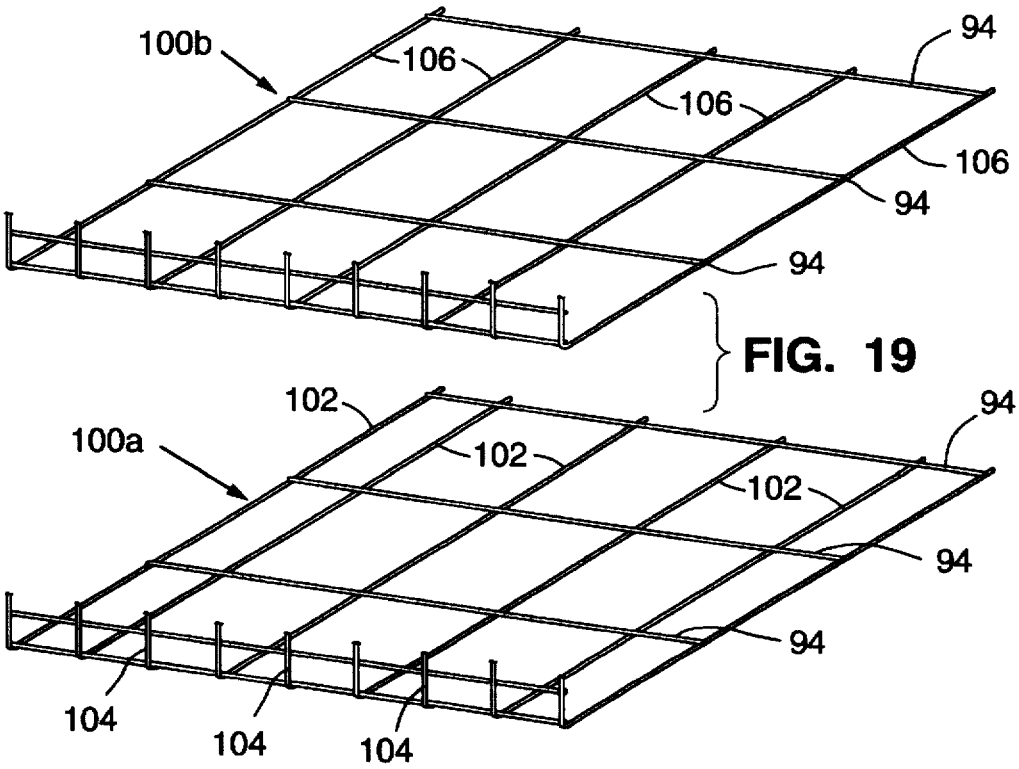

FIGS. 18 and 19 illustrate alternative spacing which may be used on the floor portion of a grid without sacrificing strength of the retaining structure. In each of the illustrated embodiments, the face portion has three by three inch spacing of members. However, in FIG. 18, the bottom grid 92*a* has transverse members 94 on the floor portion spaced at six inches apart. Likewise, the longitudinal members 96 on the floor portion of the bottom grid 92*a* are spaced at six inches apart. However, additional longitudinal members 98 are added both on the floor portion and the face portion to provide higher wire density in the face portion. The top grid 92*b* has even fewer longitudinal members 96 and the spacing is not uniform.

In FIG. 19, the bottom grid 100*a* has transverse members 94 on the floor portion spaced at six inches apart. The longitudinal members 102 on the floor portion of the bottom grid 92*a* are not uniformly spaced; some are spaced at six inches apart and some at three inches apart. Additional longitudinal members 104 are added only on the face portion to provide higher wire density in the face portion. The top grid 100*b* has longitudinal members 106 spaced at six inches apart.

It should be understood that the invention is not intended to be limited by the specifics of the above-described embodiment, but rather defined by the accompanying claims.

We claim:

1. In an earthen retaining wall structure having a plurality of wire mats each having contiguous floor and face portions comprised of spaced longitudinally extending wires having spaced transversely extending wires fixed thereto and extending thereacross wherein the floor portions are oriented in a generally parallel relationship with each other, and wherein each face portion extends upwardly from the floor portion and is interconnected with the face portion immediately thereabove, the improvement comprising a resilient connection between the floor and face portions of each mat and prongs extending upwardly from the face portions, said face portions of the mats being resiliently deflected toward the floor portions and the prongs of the mat therebeneath being threaded to opposite sides of transversely extending wires in the face portion of the mat connected thereto and released to resiliently engage said opposite sides.

2. In a retaining wall according to claim 1, the improvement further characterized in that the spacing of wires of the floor portions is greater than the spacing of wires of the face portions.

3. In a retaining wall according to claim 1, the improvement further comprising kinked portions formed on the prongs and positioned for engagement between adjacent transversely extending wires in the face portions of the connected mats when the face portions of the mats are released.

4. A wire mat utilizable for a retaining wall structure, said mat comprising:

a plurality of longitudinal members in a spaced apart generally parallel relationship;

a plurality of transverse members in a spaced apart generally parallel relationship and affixed to the longitudinal members to form a grid;

a fold line parallel to the transverse members wherein the grid is bent at substantially a right angle forming a face portion and a floor portion;

a prong portion extending upwardly from at least certain of the longitudinal members on the face portion, said prong portion having an inward bend and an outward bend positioned and proportioned to be coupled between two transverse members of a like second wire mat engaged thereover; and, wherein the face portion is resiliently deflectable toward the floor portion to enable portions of the face portion to be moved to opposite sides of the prong portion of a like mat engaged therewith and then released to resiliently impart force to opposite sides of said prong position.

5. A wire mat according to claim 4 further comprising a pin adapted to be extended across the face portion of the mat to secure the face portion to the prong portion of a like mat engaged therewith.

6. A retaining wall structure comprising:

first and second wire mats each having:

a horizontal section having a plurality of longitudinal members in a spaced apart generally parallel relationship and a plurality of transverse members in a spaced apart generally parallel relationship and affixed to the longitudinal members;

a vertical section having a plurality of longitudinal members in a spaced apart generally parallel relationship and a plurality of transverse members in a spaced apart generally parallel relationship and affixed to the longitudinal members wherein the vertical section is coupled to the horizontal section at a fold line which is generally parallel to the transverse members;

a prong portion extending upwardly from the vertical section of the first mat, said prong portion having a series of bends in a middle portion thereof and interleaving to either side of the longitudinal members of the second wire mat;

a transverse wire fixed to and extending across the prong portion of the first mat in spaced relationship to the fold line of the first mat, said transverse wire engaging one side of the face portion of the second mat; and, a first connecting pin inserted between the prong portion of the first wire mat and the longitudinal members of the second wire mat.

7. A retaining wall according to claim 6 wherein the spacing of the members in the horizontal sections of the mats is greater than the spacing of the members in the vertical sections of the mats.

8. A retaining wall structure according to claim 6 wherein the first connecting pin is engaged with the face portion of the second mat to the side thereof opposite that engaged by the transverse wire.

9. A retaining wall structure according to claim 6 further comprising a second connecting pin inserted between the prong portion of the first wire mat and the longitudinal members of the second wire mat, the first pin being disposed at the fold line to the side of the second mat opposite that engaged by the transverse wire and the second pin being disposed between the bends of the prong portion to the side of the second mat opposite that engaged by the transverse wire.

10. A method for constructing a retaining structure, comprising:

1) providing first and second welded wire mats comprising:

a horizontal section having a plurality of longitudinal members in a spaced apart generally parallel relationship and a plurality of transverse members in a spaced apart generally parallel relationship affixed to the longitudinal members, a vertical section coupled to the horizontal section at a fold line which is generally parallel to the transverse members of the horizontal section, said vertical section having a plurality of longitudinal members in a spaced apart generally parallel relationship and a plurality of transverse members in a spaced apart generally parallel relationship affixed to the longitudinal members, a prong portion extending upwardly from the vertical section and having a series of bends in a middle portion thereof, and a transverse wire fixed to and extending across the prong portions in spaced relationship to the fold line;

2) placing the first wire mat on an excavated location;

3) filling and compacting an area above the first wire mat with soil;

4) placing a second wire mat on the soil above the first wire mat;

5) interconnecting the second wire mat with the first wire mat by extending the prong portion of the first wire mat over a portion of the vertical section of the second wire mat such that the series of bends interleaves with the longitudinal members of the vertical section of the second wire mat and the transverse wire engages one side of the vertical section of the second wire mat; and, 6) inserting at least one connecting pin between the prong portion of the first wire mat and the longitudinal members of the second wire mat to the side of the vertical section of the second wire mat opposite that engaged by the transverse wire.

11. A method according to claim 10 wherein the second mat is placed above the first mat with the longitudinal members of the horizontal section of the second mat spaced from the transverse members of the vertical section of the first mat to accommodate settling of the soil.

* * * * *